United States Patent [19]
Pucher et al.
[11] 4,229,143
[45] Oct. 21, 1980

[54] METHOD OF AND APPARATUS FOR TRANSPORTING FLUID SUBSTANCES

[75] Inventors: Janos Pucher; Antal Schmider, both of Budapest, Hungary

[73] Assignee: "NIKEX" Nehezipari Külkereskedelmi Vállalat, Budapest V, Hungary

[21] Appl. No.: 566,410

[22] Filed: Apr. 9, 1975

[30] Foreign Application Priority Data

Apr. 9, 1974 [HU] Hungary ..... PU 191

[51] Int. Cl.³ ..... F04B 17/00
[52] U.S. Cl. ..... 417/53; 417/392; 417/402; 417/404; 417/383; 91/50; 91/417 R
[58] Field of Search ..... 417/53, 226, 329, 392, 417/396, 402, 225, 401, 403; 91/47, 50, 415, 417

[56] References Cited

U.S. PATENT DOCUMENTS

| | | | |
|---|---|---|---|
| 252,110 | 1/1882 | Jamieson | 91/417 X |
| 462,651 | 11/1891 | Bryan | 417/395 |
| 480,486 | 8/1892 | Barry | 91/417 X |
| 533,449 | 2/1895 | Erwin | 417/396 X |
| 886,379 | 5/1908 | Laursen | 417/396 X |
| 2,271,022 | 1/1942 | Nelson | 417/392 |

*Primary Examiner*—Leonard E. Smith

[57] ABSTRACT

The present invention relates to a method and an apparatus for transporting in alternating suction and displacement strokes of fluid substances, e.g., water, slurry, etc., by quanta by means of the potential energy of a primary liquid column by interposing a system of vessels sealed off from the atmosphere between the primary liquid column and the secondary fluid substance basis.

4 Claims, 10 Drawing Figures

METHOD OF AND APPARATUS FOR TRANSPORTING FLUID SUBSTANCES

The present invention relates to a method of and an apparatus for transporting fluid substances such as water, slurry and other similar fluids by consecutive suction and forcing strokes of quanta of the fluid substance, by means of the potential energy of a primary liquid column. The apparatus incorporates a system of vessels sealed off from the atmosphere between the primary liquid column and the secondary fluid substance basis.

It is of general knowledge that certain industrial plants may avail themselves of large quantities of water which has already been used in industrial processes, and that at the same time they are compelled to pump fresh water, possibly from some deep-level source to the point of utilization. The used water is often discharged into a sump without making use of the potential energy available in it due to the comparatively high level of such water. Certain machines, e.g. rotary pumps connected with turbines and auxiliary engines for utilization of the energy of used water are well-known to those skilled in the art. These machines are, however, capable of providing an energy utilization of no more than 40 to 65 percent of that which is theoretically possible.

Equipment working on the liquid transformer principle and utilizing either the kinetics or the potential energy of used water are also known. However, the efficiency of equipment belonging to the aforementioned group, e.g. the water jet pump and the hydraulic ram, is as low as about 10 to 30 percent, and therefore their practical application has not proved to be useful in industrial plants disposing of used water stocks representing high water column heights, in the cooling-water supply of deep mines, or in the delivery of slurries and similar substances. As regards delivery of slurry, various slurry pumps are used which are in fact highly reliable mechanisms, but owing to their unfavorable efficiency they have high power demands which are additionally increased by friction losses occurring in the delivery pipe.

The procedure and equipment described in Hungarian Pat. Specification No. 160,966, working similarly on the liquid transformer principle, is applicable at a highly favorable efficiency, for example 85 to 90 percent, for delivery of a secondary liquid by utilizing the pressure (potential) energy of the primary liquid column. In this solution, the secondary liquid to be lifted is delivered from the basis thereof by syphonage in the first (suction) stroke into a system of vessels acting as a sluice, to be transferred from this system in the second (forcing) stroke into the source by means of the potential energy of the primary liquid. The enclosed system of vessels is connected with the downtake (primary) conduit and the uptake (secondary) conduit by pipes incorporating shut-off means which can be opened and closed. The system of vessels may include partition walls, chiefly flexible membranes capable of displacement. These may be interconnected with energy storage means, such as springs, weights, and the like, which upon displacement during the pressure stroke will store the energy and utilize the latter for performing the suction stroke.

Though this solution is favorable for many reasons, its applicability is, to a certain degree, limited by the fact that the simplest implementation requires a difference in water levels in order to ensure syphonage; and as regards the energy storage type equipment, the limited extent of the possibility of energy storage sets limits to the manners of its applicability.

The purpose of the present invention is to provide a solution eliminating the drawbacks and deficiencies of the earlier solutions serving similar purposes where operation of the equipment does not require syphonage, and where the energy storage means (e.g. springs, weights and other similar means) are not required to be incorporated in the enclosed system of vessels. A further object of the invention is to enable the vertical and horizontal delivery of fluid substances at optimum energy utilization by application of the many varied practical implementations of the invention in widely different fields, e.g. in the cooling-water supply of deep mines, in slurry delivery, in power plants erected at high altitudes, in industrial plants, and in utilization of the energy of small dams and the like.

The invention is based on the recognition of the fact that utilization of the potential (pressure) energy of the primary liquid enables not only the forcing out of the secondary fluid from an enclosed system of vessels, i.e. the carrying out of the forcing stroke, but also the suction of a quantum of a secondary fluid into the enclosed system of vessels, i.e. that the required energy demand of the suction stroke can also be covered which, if necessary, may also be varied.

Based on this recognition, the method according to the invention is carried out, generally by means of the procedure already mentioned above, as follows: During the suction stroke a certain volume of the secondary fluid substance is sucked into a system of vessels sealed off from the atmosphere by means of the pressure of the primary liquid column or of some other pressure medium, e.g. compressed air or the secondary fluid substance pressurized at least in part by the potential energy of the primary liquid, while during the forcing stroke, a pressurized liquid quantum of the primary liquid column is admitted into the system of vessels so as to force out the quantum of the secondary fluid substance previously sucked into it. The volumes of the primary liquid used for performing the work are forced out from the system of vessels sealed off from the atmosphere by utilizing the potential energy (pressure) of the primary liquid column, column, while during the alternating suction and displacement strokes the primary liquid and secondary fluid substance quanta are partly or fully prevented from mixing with each other.

It is to be understood that the primary liquid is the actuating liquid having a potential energy, and this liquid is usually water, while the secondary fluid substance is the substance to be delivered, that is, water, slurry, or some similar substance. In certain cases the primary and secondary liquid are identical: In cases when e.g. irrigation water to be distributed from some natural water source is lifted to some higher level; the head prevailing in the intake provides the head of the primary liquid column and the secondary liquid to be lifted is also supplied from the same source. It is also mentioned that the terms "primary" and "secondary" liquids are to be given the widest possible meaning; these may be contained in open or enclosed artificial basins, tanks or other similar means, but may also be natural liquid reservoirs, water courses, or similar natural waters, etc.

It may also happen that the primary liquid is led in a cold state from the equipment into a pipeline, and after being used for cooling purposes, it is returned in a warm state into the secondary-end suction tank of the equipment, thus forming the secondary liquid, and all this while the liquid never emerges from the enclosed system.

The apparatus serving for the practical carrying out of the procedure incorporates a downtake conduit communicating with the primary liquid base which serves for conducting the primary liquid, a conduit for delivery of the secondary fluid substance, and a system of vessels sealed off from the atmosphere which is connected with the downtake conduit by means of interposed shut-off means and with the secondary fluid substance base and the pipeline for delivery of the secondary fluid and is fitted with an openable and closeable draining means for discharging the primary liquid. The essence of this apparatus is that it incorporates a mechanism movable between two end-positions within the system of vessels sealed off from the atmosphere and divides at least one chamber of the system of vessels during the suction and forcing strokes into spaces of varying volumes. The apparatus includes at least two surfaces that can be exposed to actuating pressures acting in opposing directions, at least one of these surfaces being arranged so as to be directly exposed to the head of the primary liquid. The said reciprocating mechanism has at least one surface in forced coupling with the above-mentioned surfaces for forcing out quanta of the secondary fluid substance from the system of vessels sealed off from the atmosphere.

The invention includes several additional novel and advantageous features to be discussed below.

The apparatus of this invention features a very high degree of energy utilization; in practical cases, an energy utilization of approximately 75 to 90 percent may economically be realized, and the upper value of that range can be approximated with high primary water column heads. This high efficiency is practically independent of changes in the discharge and is almost constant, meaning that constantly high energy utilization is ensured even though the primary liquid discharge varies within certain limits. The equipment is suited for delivery of any fluid substance; its operation can be automated easily and can be made fully automatic. Automatic operation, high reliability in operation, long life expectancy, high reliability are all outstandingly favorable factors. The simple mechanism of the equipment enables simple manufacture and in general no special materials are required.

The advantages of the equipment are particularly conspicuous when applied to the cooling systems of deep mines, where Pulton turbine recuperation has hitherto been applied, up to depths of approximately 700 meters, and in the case of deeper mines, high-pressure heat exchangers or underground cooling tower systems have been employed. Owing to the high degree of energy utilization and the direct usability at low pressure of the cooling water led down to deep levels, this invention considerably reduces the power demand, and also reduces the investment costs of the whole cooling system, thus being more favorable than the earlier solutions. Application of the equipment provided by this invention renders the use of aggressive coolants unnecessary. The equipment can flexibly be adapted to any deep-mining system.

As will be described in more detail hereinbelow, the invention lends itself to application in the hydraulic transport of materials at outstandingly favorable efficiency, e.g. preferably for the delivery of fine slurry, such as chalk, clay, pulverized coal and similar substances from mines and openwork. The potential energy of small dams (barrages) can favorably be utilized by means of the invention for irrigation or water supply. Further favorable applications include hydraulic power recuperation in power plants built on high banks, in industrial plants and in many other cases, e.g. filling of hydraulic energy storage means, lifting of drinking water from wells drilled on the shore, etc.

In the following, the invention will be described in detail based on the attached drawings which represent, by way of example, some illustrative embodiments of apparatus serving for the practical implementation of the method of the invention.

In FIGS. 1–6, inclusive, and 10, the movable parts of the apparatus are shown in an intermediate operating position.

Figure 1:
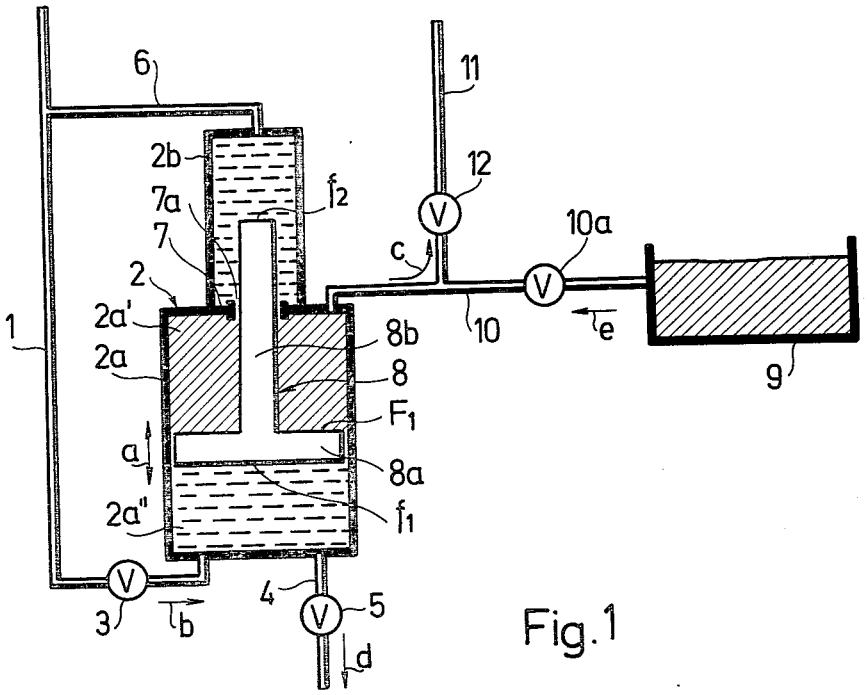
FIG. 1 is a schematic view in vertical section through a first, single-acting embodiment of the apparatus.

Turning now to FIG. 1, the system of vessels there shown sealed off from the atmosphere in denoted by reference numeral 2, this system being formed by chambers 2*a* and 2*b*. Downtake conduit 1 is connected to the bottom part of chamber 2*a;* downtake conduit 1 contains the primary liquid which is to dispose of potential energy. A shut-off valve 3 is interposed in conduit 1 before its inlet to chamber 2*a*. Draining conduit 4 incorporating a shut-off valve 5 is similarly connected to the bottom part of chamber 2*a*. The upper chamber 2*b* is connected with downtake conduit 1 above valve 3 by means of a conduit 6.

Chambers 2*a* and 2*b* are separated by a wall 7 having a central aperture 7*a* formed therein. Actuating mechanism denoted as a whole by reference numeral 8 is accommodated in chambers 2*a*, 2*b;* the actuating mechanism has a piston-like plate 8*a* and a rod or stem 8*b;* the latter one is led through aperture 7*a* which is provided with a packing. The cross-section of plate 8*a* is essentially identical with that of chamber 2*a*, and can be reciprocated in chamber 2*a* like a piston in the direction of double-ended arrow a. Tight sealing between the inner surface of chamber 2*a* and the peripheral lateral surface of plate 8*a* is ensured by piston rings or the like (not shown) during the reciprocating motion of actuating mechanism 8.

The equipment is connected with the basin of the secondary fluid substance to be delivered, in the present case with a basin 9 continuously replenished with the secondary fluid substance, the basin being connected with the upper part of chamber 2*a* via conduit 10. Piston plate 8*a* thus splits up chamber 2*a* into two spaces 2*a'* and 2*a''*, the capacities of which vary in opposite directions during operation; space 2*a''* is connected with downtake conduit 1, space 2*a'* is connected with basin 9, and, as noted, uptake 11 delivers the secondary liquid substance. A shut-off valve 10*a* is incorporated in conduit 10 before its inlet into basin 9, and a shut-off valve 12 is interposed in uptake 11 after branching off from conduit 10. The bottom surface of piston 8*a* is denoted $f_1$, the upper front face of stem 8*b*, which is accommodated in chamber 2*b* moving upwards and downwards in the chamber during operation but always remaining within the chamber, is designated by reference symbol $f_2$.

The secondary fluid substance is delivered by the apparatus shown in FIG. 1 as follows:

Before commencement of the forcing or driving stroke, piston 8*a* assumes its lower terminal position, and space 2*a'* has been filled during the previous suction stroke with the secondary fluid substance to be delivered. The forcing stroke commences by the opening of shut-off valves 3 and 12 and by the closing of shut-off valves 5 and 10*a*. Primary liquid disposing of potential energy flows from downtake conduit 1 in the direction of arrow b into space 2*a''* and forces piston 8*a* and thus the whole actuating mechanism 8 upward; this forces the secondary fluid substance from space 2*a'* via conduit 10 and the open shut-off means 12 in the direction of arrow c into uptake 11. Since conduit 6 does not incorporate any shut-off means, pressure p of the primary actuating liquid also prevails in chamber 2*b* and in downtake conduit 1. Actuating mechanism 8 can, however, easily move upwards under the effect of thrust $pf_1$, since the ratio $f_1 > f_2$ exists in chambers 2*a* and 2*b* between the surfaces exposed to the head of the primary liquid. During the forcing stroke, primary liquid is obviously forced back into downtake conduit 1 while stem or piston rod 8*b* is moving upwards.

As soon as piston 8*a* reaches its upper terminal position, shut-off valves 3 and 12 are closed, shut-off valves 5 and 10*a* are opened, and thus the suction stroke commences. The thrust $pf_2$ acts on the upper face of piston rod 8*b*, whereby piston 8*a*, relieved from the head of the primary water column, is forced to move downwards. During the course of this motion, piston 8*a* forces out, via conduit 4, the primary liquid forced into space 2*a''* during the forcing stroke, and secondary fluid substance is sucked into space 2*a'* from basin 9 in the direction of arrow e. When piston 8*a* assumes its bottom terminal position, shut-off valves 5 and 10*a* are closed, and by opening shut-off valves 3 and 12, the forcing stroke commences, and the already described working phase will be continuously repeated.

Figure 2:
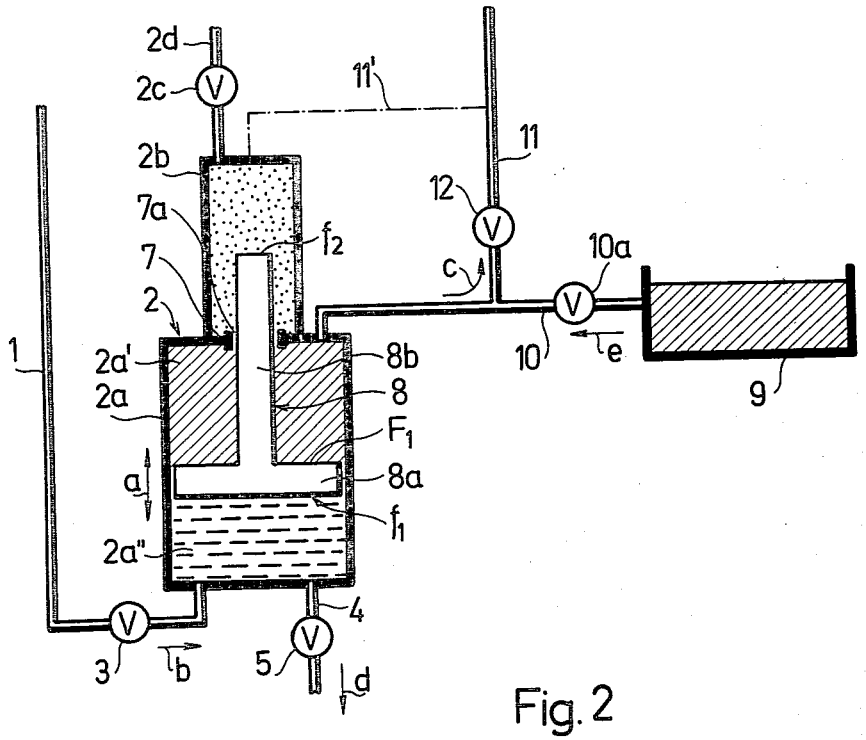
FIG. 2 is a view similar to FIG. 1 of a second embodiment of the apparatus of the invention.

FIG. 2 displays an example of the apparatus of the invention that in many respects is essentially identical with that of FIG. 1; parts of the mechanism shown in FIG. 2 which are the same as those in FIG. 1 are therefore denoted by the same reference numerals. A difference between FIGS. 1 and 2 occurs only in the downward motion of mechanism 8, i.e. in conducting the suction stroke. In such suction stroke, surface $f_2$ of piston rod 8*b* in FIG. 2 is not exposed to head p of the primary liquid but to another pressure medium. This latter is, by way of example, compressed-air introduced into chamber 2*b* via a pipe stub 2*d* fitted with a shut-off valve 2*c*, or the secondary fluid substance may be led into chamber 2*b* through conduit 11' denoted by a phantom line. The section above shut-off valve 12 of uptake 11 contains the secondary fluid substance which is always pressurized during delivery, a quantum of which during each suction stroke flows into chamber 2*b* and is forced back during each forcing stroke into uptake 11.

Figure 3:
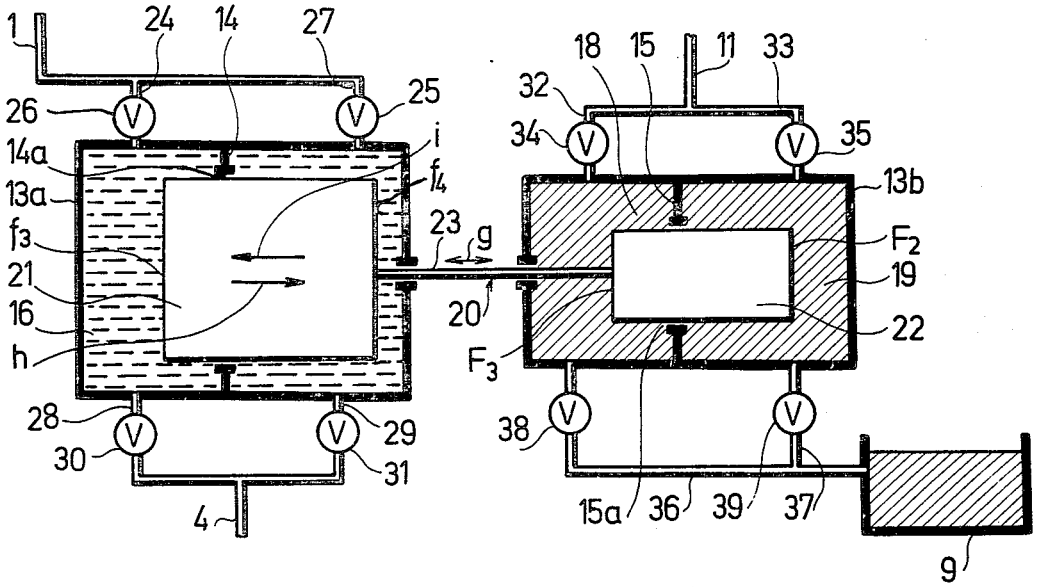
FIG. 3 is a schematic view in vertical section of a third embodiment of the apparatus of the invention, such embodiment being double-acting.

FIG. 3 illustrates a further example of the practical implementation of the apparatus provided by the invention; identical parts of the mechanism shown in FIG. 3 and in subsequent figures are denoted by the same reference characters. A system of vessels is formed in this case by chambers 13*a* and 13*b* which are completely separated from each other, and are split up by internal partition walls 14, 15 into spaces 16 and 17, on the one hand, and spaces 18, 19, on the other hand. The mechanism denoted as a whole by reference numeral 20 consists of piston-like bodies 21 and 22 interconnected by rod 23. Body 21 is accommodated in chamber 13*a* and passes through aperture 14*a* provided in inside partition wall 14 with a packing providing sealing even during motion; body 22 is arranged in the same way in chamber 13*b* guided in aperture 15*a* of partition wall 15 with a packing also ensuring sealing during its motion.

Spaces 16, 17 of chamber 13*a* are connected with downtake conduit 1 by means of a conduit 23 with the interposed shut-off valves 26 and 27 built into pipe legs 24 and 25. Draining conduit 4 is connected with spaces 16 and 17 of chamber 13*a* by means of pipe legs 28 and 29. Pipe leg 28 incorporates shut-off valve 30, and pipe leg 29 incorporates shut-off valve 31.

Spaces 18 and 19 of chamber 13*b* are similarly connected by means of suitable leg pipes 32, 33 with uptake 11, and via pipe legs 36, 37 with basin 9 containing the secondary liquid to be delivered. Pipe leg 32 incorporates shut-off valve 34, pipe leg 33 incorporates shut-off valve 35, whereas a shut-off valve 38 is built into pipe leg 36 and a shut-off valve 39 is interposed in pipe leg 37.

By means of the equipment apparatus shown in FIG. 3, delivery of the secondary fluid substance takes place as follows:

Since two primary liquid chambers and two secondary fluid chambers are provided, actuating mechanism 20 performs, during its motions in both directions of arrow g simultaneously a suction and a forcing stroke. When body 21 starts moving from the left-hand end position shown in FIG. 3 to the right, feed-end shut-off valve 26 belonging to space 16 and discharge-end shut-off valve 31 belonging to space 17 at chamber 13*a* are open, while shut-off valves 27 and 30 are closed; at the same time, at chamber 13*b*, shut-off valves 35 and 38 are open and shut-off valves 34 and 39 are closed. On starting, space 18 is empty, and space 19 is filled with the secondary fluid substance to be delivered. As the primary liquid of head p flows into space 16, actuating mechanism 20 is shifted in the direction of arrow h to the right by force $pf_3$, as a result of which the primary liquid sucked into space 17 in the previous stroke flows out from space 17 via the open shut-off valve 31 and the draining conduit 4, and the liquid is forced from the space 19 of chamber 13*b* via the open shut-off valve 35 into uptake 11 and via pipe leg 36, secondary fluid substance is sucked into space 18, following body 22 being rigidly connected with body 21 by rod 23 and moving to the right.

As soon as bodies 21 and 22 reach their right-hand end position, shut-off valves 26, 31 and 38, 35 are closed and shut-off valves 34, 39 and 25, 30 are opened. Then primary liquid with a head p streams from downtake conduit 1 into space 17 to displace body 21 in the direction of arrow i, with a force $pf_4$. Upon this effect, the primary liquid flows out via pipe leg 28, shut-off valve 30 and draining conduit 4, body 22 forces from space 18 via the the open shut-off valve 34 and conduit 32 the secondary fluid substance sucked off during the previous stroke, into the uptake 11, and secondary fluid substance is sucked into space 19 from basin 9 via pipe leg 37. When bodies 21 and 22 reach their left-hand end position, the shut-off valves are opened and closed in the manner already described, and the working phases are then continuously repeated in the above-mentioned manner.

Figure 4:
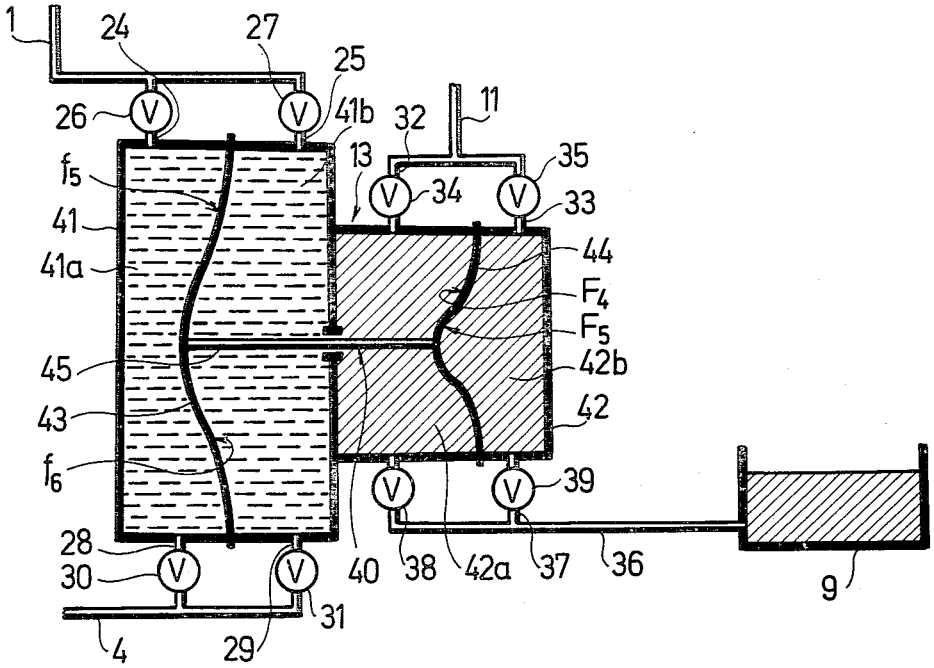
FIG. 4 is a schematic view of a fourth embodiment of the apparatus of the invention, such apparatus being double-acting and employing a deformable membrane.

FIG. 4 represents an example of the apparatus that is similar to that of FIG. 3, and the identical parts of the mechanism are therefore denoted by the already applied reference characters. The only difference between FIGS. 3 and 4 occurs in the design of mechanism 40 performing reciprocating motion and in that chambers 41 and 42 are arranged directly beside each other. Actuating mechanism 40 includes a membrane 43 accommodated in chamber 41 and a membrane 44 arranged in chamber 42. The membranes are clamped around their edges and divide each chamber into two spaces 41*a*, 41*b* 42*a*, 42*b*, respectively separated from each other. The membranes are interconnected by rod 45. Operation of the equipment shown in FIG. 4 in otherwise fully identical with that of FIG. 3, the only difference being that the forcing and suction effects are produced by the motion of flexible membranes instead of piston-like bodies.

In one of the examples of practical implementations shown in FIG. 5, at the left-hand side of the system of vessels 106 closed off from the atmosphere, there is accommodated a chamber 46 for holding the primary actuating liquid which chamber incorporates two inside spaces 46*a*, 46*b*; feeder and draining pipe legs already discussed in connection with FIG. 3 and denoted by the mentioned reference numbers connect these spaces and are fitted with the proper shut-off valves. One side of the right-hand chamber 47 is formed by membrane 48, the outer surface of which is connected with a rod 49, whereas the other end of rod 49 is connected to a pistonlike body 50 moving in chamber 46. These parts form the mechanism performing reciprocating motion which is denoted in full by reference numeral 107. Conduit 51 is led into chamber 47 from basin 9 containing the secondary fluid to be delivered and the said conduit incorporates a shut-off valve 52. Uptake 11 is led out from the upper part of chamber 47 and incorporates a shut-off valve 53.

Figure 5:
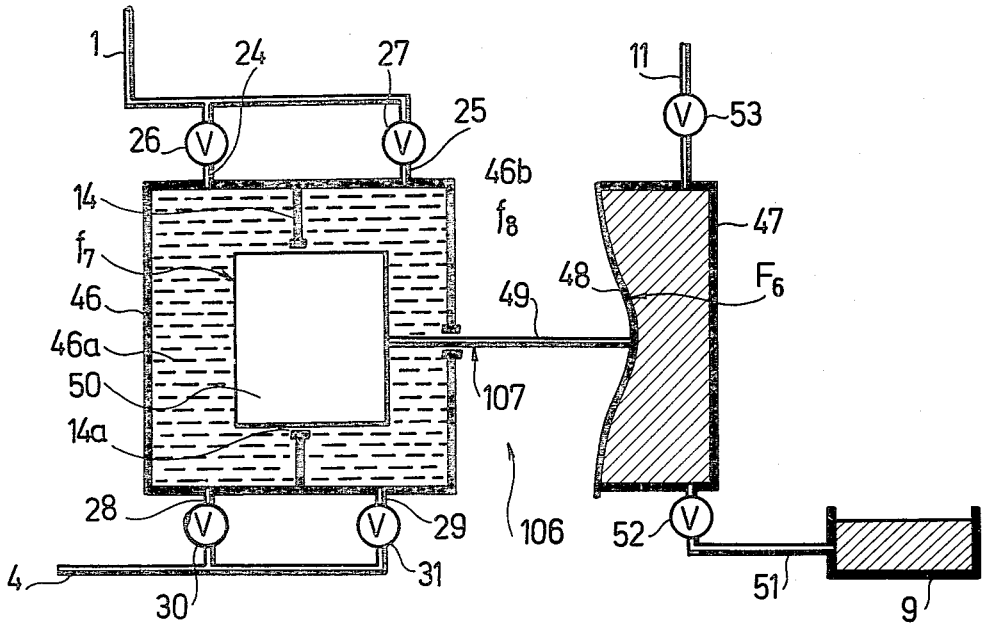
FIG. 5 is a schematic view in vertical section through a fifth embodiment of the apparatus, such apparatus featuring double-action at the primary end and a single-action at the secondary end.

The manner of operation of the apparatus of FIG. 5 is apparent from the foregoing: In the forcing stroke, shut-off valves 27, 30 and 52 are closed and shut-off valves 26, 31 and 53 are open. Thus, when the primary water column head moves the body 50 from the left to the right, membrane 48 is displaced in the same direction and forces the secondary liquid substance drawn into chamber 47 during the previous suction stroke into uptake 11; body 50 forces the primary actuating liquid sucked into space 46*b* during the previous suction stroke into draining conduit 4. During the suction stroke, body 50 moves from the right to the left, and membrane 48, moving in the same direction, sucks secondary fluid substance into chamber 47. The suction stroke is initiated by shutting off shut-off valves 26, 53 and 31, and by opening shut-off valves 27, 30 and 52. By continuously repeating the afore-described opening and closing operations, intermittent secondary fluid substance delivery can be provided.

It is evident that connected with face $f_7$ of piston 50 of the apparatus shown in FIG. 5 to the left from chamber 46*b*, another chamber (not shown) limited at one side by a membrane, can also be operated, the secondary forcing conduit of such other chamber being connected after the shut-off valve with uptake 11. In such a way, a double-acting equipment suitable for continuous slurry delivery can be produced which also has the advantage that failure of the membranes making contact with the slurry can be directly detected, and the membrane can be replaced easily.

Figure 6:
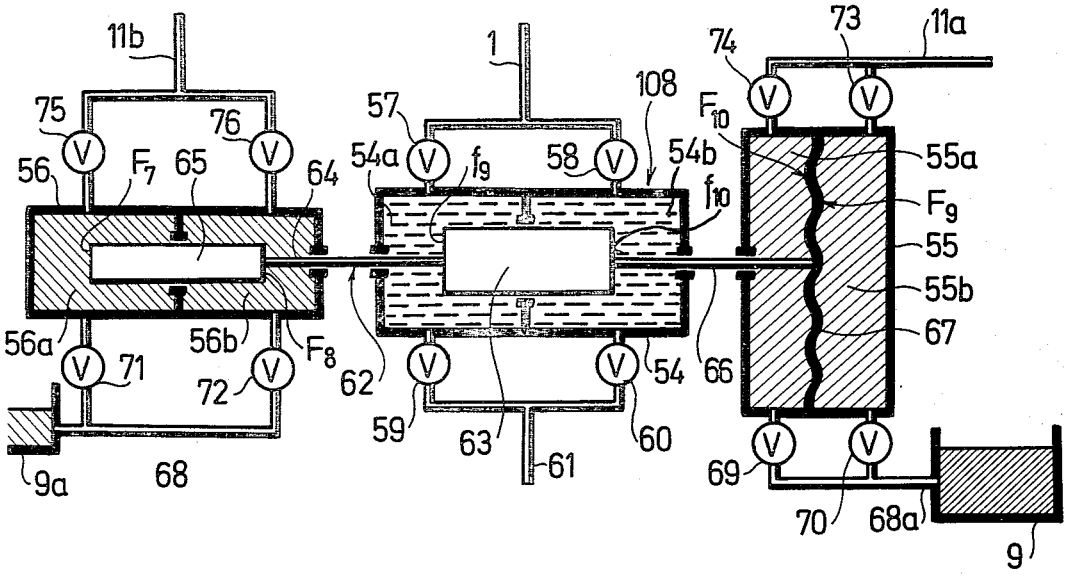
FIG. 6 is a schematic view in vertical section of a sixth embodiment of the apparatus, such apparatus having a three-chamber system of vessels.

By means of the apparatus shown in FIG. 6, two different sorts of secondary fluid substances can be delivered simultaneously from two sources, in the present case from two basins. In this case, the closed system of vessels denoted as a whole by reference numeral 108 is formed by chambers 54, 55 and 56. Spaces 54*a* and 54*b* of chamber 54 are connected by means of suitable pipe legs and through the incorporated shut-off valves 57, 58, with uptake 1 and via shut-off valves 59, 60 with draining conduit 61. The mechanism denoted as a whole by reference numeral 62 consists of a piston-like body 63 moving in chamber 54, a similarly piston-like body 65 arranged in chamber 56 and connected to body 63 by rod 64 and a membrane 67 built in chamber 55 and connected with body 63 by rod 66. The surfaces which can intermittently be subjected to the load of the primary liquid head and provided with reciprocating motion for actuating mechanism 62 are denoted by reference numerals $f_9$ and $f_{10}$. Chambers 55 and 56 are connected with basins 9, 9*a* containing the secondary liquid to be delivered by the method already described in connection with the previous examples of the practical implementation, by means of shut-off valves 69 and 70, respectively 71 and 72 built into the pipe legs branching off from the suction conduit. In the present solution, two uptakes ll*a*, ll*b* serve for delivering the secondary fluid substances, the first one being connected with chamber 55 via shut-off valves 73 and 74, the second one with chamber 56 via shut-off valves 75 and 76.

The equipment shown in FIG. 6 operates as follows: When actuating mechanism 62 moves from the left to the right it forces out from spaces 55*b* and 56*b* the corresponding secondary fluid and sucks it into spaces 55*a* and 56*a*, whereas when such mechanism moves from the right to the left, it inverts the consecutive order of the forcing and suction strokes in the chambers. The motion of actuating mechanism 62 from the left to the right is produced by force $p.f_9$ acting on surface $f_9$ where p is the head of the primary liquid column. The shut-off valves 57 and 60, as well as valves 73, 69 and 76, 71 are open, while shut-off valves 59 and 58, as well as shut-off valves 70, 74 and 72, 75 are closed. For moving actuating mechanism 62 in the opposite sense, shut-off valves 57 and 60, 69 and 73 as well as valves 76 and 71 are shut off, and shut-off valves 58 and 59, 74 and 70 as well as valves 75 and 72 are opened. By continuously repeating these operations, material can simultaneously be delivered from one secondary fluid source to two points of utilization. It is mentioned that material, preferably slurry of considerably larger volume than the capacity of space 54*b* can be sucked into membrane chamber 55 which can further be delivered at a lower lift, whereas from chamber 56, material e.g. water of volume smaller than the capacity of space 54*a*, can be delivered at a larger lift.

Figure 7:
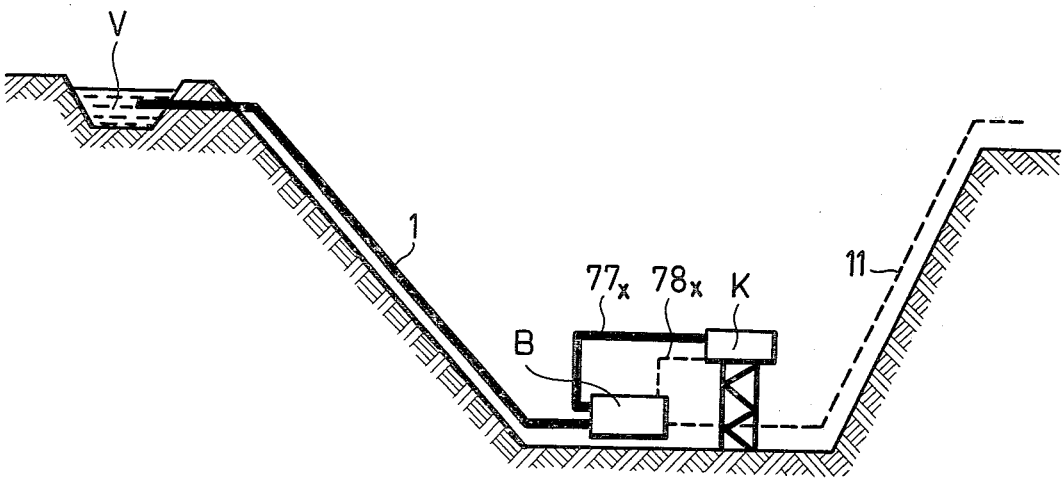
FIG. 7 is a schematic view in lateral elevation of a slurry delivery system incorporating equipment provided by the present invention.

The schematic lateral elevation of a system for delivery of slurry, based on application of the invention is shown in FIG. 7. The primary liquid source, e.g. some natural water course, is denoted by the reference symbol V. Downtake 1 leads from this source and is led, by way of example, into a slurry delivery equipment according to FIG. 4 denoted as a whole by reference symbol B. This is connected with tank K of a mixer tower acting as a secondary fluid source, via forward conduit 77 and return conduit 78 denoted by a dash line. It is well-known that the power demand of slurry delivery systems working with high-pressure water pumps can be expressed by the formula $$E = \frac{Q_z \cdot \gamma_z \cdot H_g}{\eta_{sz}} + H_{cs}$$

where $Q_z$ is the slurry yield, $\gamma_z$ the specific weight of the slurry, $H_g$ is the geodetic pumping head, $H_{cs}$ is the pipe friction loss and $\eta_{sz}$ is the efficiency of the pump. By separating the power demands of the water used for delivery and of the delivered slurry, the following relation is obtained:

$$E = \frac{Q_v \cdot \gamma_v \cdot H_g}{\eta_{sz}} + \frac{Q_a \cdot \gamma_a \cdot H_g}{\eta_{sz}} + H_{cs}$$

where index "a" denotes the material, and "v" denotes water. It will be clearly seen from this relation that the power demand of the known slurry delivery systems is burdened by the mass of water used for delivery to a considerable extent; the thinner the slurry, the larger is the volume of water. If, however, the slurry is thick, pipe friction assumes very high values.

Highly significant power economies can be achieved by means of the arrangement of FIG. 7, as will be clear from the following description. The system works as follows:

The yield of open cut mining is lifted in the form of slurry, hydraulically. For this purpose, the water of source V is passed on via downtake 1 into equipment B according to the equipment provided by the invention. Water is led via conduit $77_x$ into tank K where slurry is produced by mixing the yield to be delivered with water, the slurry thus mixed is returned via conduit $78_x$ by means of the head of the primary water column in conduit 1 into equipment B, and therefrom it is displaced by a pipeline 11 to its point of destination. In this system, the energy balance, setting out from relation $Q_z = Q_a + Q_V$, will be as follows:

$$E = \frac{Q_v \cdot \gamma_v \cdot H_g}{\eta'} + \frac{Q_a \cdot \gamma_a \cdot H_g}{\eta'} + H_{cs}$$

$$\frac{Q_v \cdot \gamma_v \cdot H_g}{\eta'} + H_v =$$

$$\frac{Q_a \cdot \gamma_a \cdot H_g}{\eta'} + H_{cs} + H_v$$

where $H_v$ is the friction loss of water delivery pipe, and $\eta'$ is the efficiency of equipment B.

It will be clearly seen from the above-mentioned relation that if the invention is applied, all that is to be covered by separate energy input is the energy demand of the material to be delivered, the loss of the slurry pipe and the comparatively very small loss of the water delivery pipe, but not the energy required for forwarding the mass of water acting as the transport medium. Since thin slurry may also be transported economically, the friction loss of the slurry transporting tube also decreases considerably, meaning a further economization. The vertical lifting of material performed in this way may even prove to be economically feasible if, in the case where suitable water sources are unavailable, measures have to be taken for the repeated recuperation and recirculation of water from the slurry.

Figure 8:
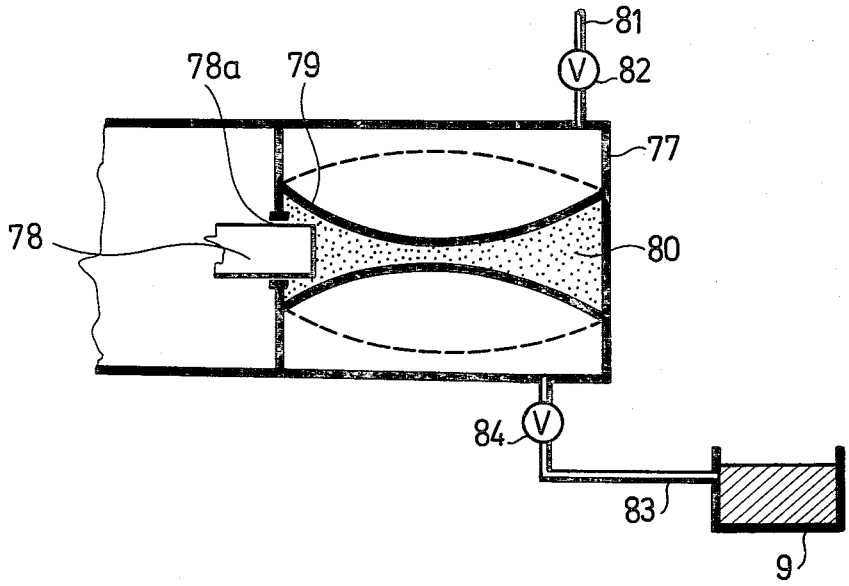
FIG. 8 shows a chamber in vertical section where a flexible hose is incorporated in order to separate the mechanism performing.

FIG. 8 represents a schematic section across a detail of a mechanism, the application of which may prove to be particularly useful when slurries of considerably abrading structural materials or corrosive liquids are delivered. Piston-like body 78 reciprocates in chamber 77 (which forms part of a slurry transport equipment similar to or identical with the practical implementations already mentioned by way of example), serving for sucking in and forcing out a secondary liquid (in the present case, slurry). The said piston, however, does not make contact with the slurry arrising from basin 9 via conduit 83 and gate valve 84, since a hose-like flexible separating element 79 is arranged within the chamber which contains pure pressure transferring liquid 80 exerting no wearing effect on piston 78 and its passage 78*a*. The position of element 79 at the commencement of the forcing stroke is denoted by a full line, and its position at the completion of the forcing stroke by a broken line. A gate valve 82 is built into uptake 81 and the slurry is forced upwards through these parts of the equipment.

Figure 9:
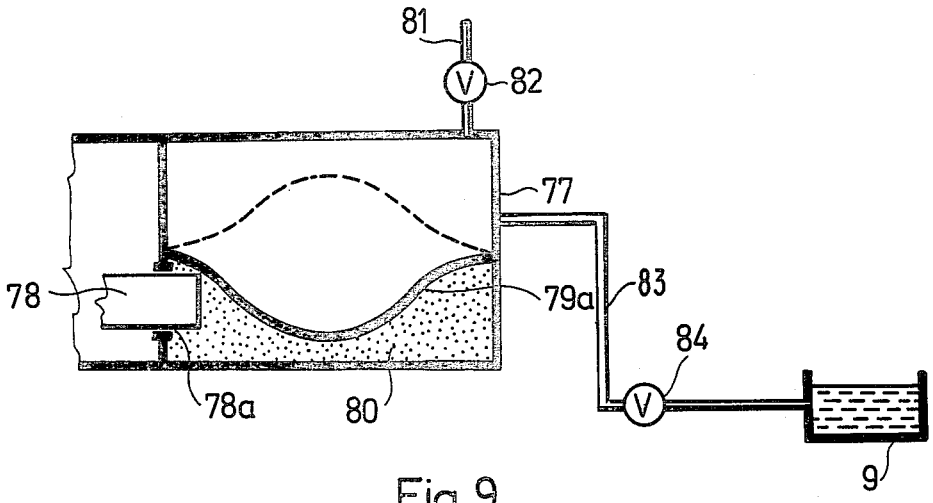
FIG. 9 is a view similar to FIG. 8 of a variant of the apparatus shown in FIG. 8.

The apparatus shown in FIG. 9 differs from that of FIG. 8 only in that the flexible separating member is not hose-like but is formed, in fact, by a flexible sheet 79*a*, and the piston-like body 78 reaches into chamber 77 at the bottom, below sheet 79*a*. Body 78 and its passage 78*a* also makes contact in this case with the pure pressure transferring liquid 80.

Figure 10:
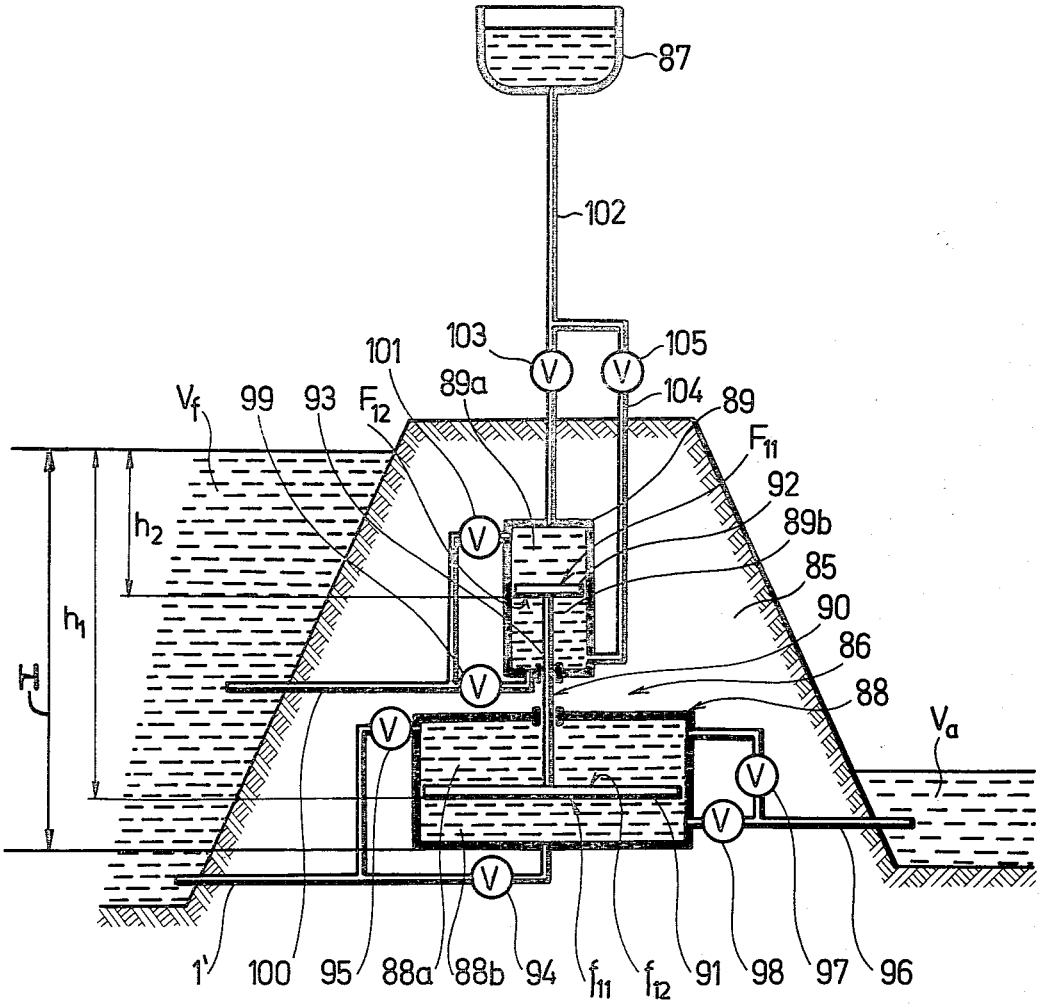
FIG. 10 is a schematic view in vertical section through an apparatus in accordance with the invention employed for irrigation purposes.

FIG. 10 is a schematic vertical section across a water-raising system based on a solution provided by the present invention which can be used, for example, for the drawing-off and distributing of irrigation water. The system of vessels sealed off from the atmosphere and denoted as a whole by reference numeral 86 is built in, e.g. in a body 85 belonging to a dam (barrage), with upstream water $V_f$ at the left-hand side and downstream water $V_a$ at the right-hand side. In the present case, both the primary and the secondary liquid source are supplied by upstream water $V_f$, because the water column head of $h_1$ of that water is now used for forcing water $V_f$ through the enclosed system of vessels 86 into irrigation water trough 87 situated at a high level wherefrom the irrigation water can be passed on by gravity into the irrigation channel network.

The system of vessels 86 consists of chambers 88 and 89 accommodating reciprocating mechanism 90, which in the illustrative embodiment moves upwards and downwards, and consisting of blade 91 moving in chamber 88, of blade 92 moving in chamber 89 and of stiff rod 93 interconnecting the said blades. The blades divide the chambers into spaces 88*a* and 88*b*, respectively 89*a* and 89*b*. One leg fitted with a shut-off valve 94 of primary forcing conduit 1' is led into space 88*b*, while its other leg fitted with a shut-off valve 95 is led into space 88*a*. Shut-off valve 97 is built into the leg led out from space 88*a* of draining conduit 96 leading into downstream water $V_a$, while shut-off valve 98 is built into its leg led out from space 88*b*. The blade surfaces are denoted by reference symbols $f_{11}$, $f_{12}$, respectively $F_{11}$, $F_{12}$; the ratios between the areas of the blade surfaces are $f_{11}>F_{11}$ and $f_{12}>F_{12}$.

The feeder conduit leading from upstream water $V_1$ into secondary chamber 89 is denoted by reference numeral 100; a shut-off valve 99 is built in its leg leading into space 89*b* and a shut-off valve 101 is incorporated in the leg run into space 89*a*. Space 89*a* is connected with trough 87 by uptake 102 incorporating gate valve 103. From space 89*b*, a pipe leg 104 connects above shut-off valve 103 to uptake 102. A shut-off valve 105 is built in pipe leg 104.

The raising of water by means of the doubleacting differential piston-type pressure boosting equipment of FIG. 10 takes place as follows:

We start from the case where mechanism 90 is in the bottom end position, spaces 88*a* 89*a* contain water sucked in during the previous stroke, and all shutoff valves are closed. Now, shut-off valves 94 and 97, as well as shut-off valves 99 and 103 are opened, whereupon the upstream water column of head H forces mechanism 90 upwards with a force of $H\cdot\gamma\cdot f_{11}$ ($\gamma=1$ is the specific density of water). Consequently, water flows from space 89*a* via uptake 102 into trough 87 and simultaneously water is sucked into spaces 88*b* and 89*b*. When mechanism 90 reaches its top end position, shut-off valves 103, 99, 97 and 94 are closed and shut-off valves 105, 101, 95 and 98 are opened, and upon this effect, compressive force $f_{12}\cdot h_1\cdot\gamma$ acting on surface $f_{12}$ of blade 91 forces mechanism 90 downwards, whereupon blade 92 forces water from space 89*b* at force $F_{12}\cdot h_2\cdot\gamma$ through conduit 104 into conduit 102, respectively into trough 87. It should be mentioned that $h_1$ and $h_2$ are variables but their difference is constant. By continuous repetition of the afore-described phases, the raising of liquid is made essentially continuous.

The invention is obviously not limited to the ways of practical implementation and application methods described above by way of example only; within the field covered by the patent right determined by the following claims, many other versions may additionally be implemented. As regards the shut-off means, for example, any mechanisms which can be changed over, e.g. gate valves, slide valves and other means for shutting off streaming liquids, suitable for the purpose of the invention herein described, are applicable. As regards the shut-off means, it is a common trait of the equipment of the present invention that shut-off means requiring changeover action shall be incorporated in conduits delivering the primary liquid, whereas in the pipes delivering secondary fluid, shut-off means changing over automatically upon changes in the pressure conditions, e.g. ball, check and foot valves, etc., are preferably employed.

When control of the opening and closing of shutoff means requiring changeover and thus of the suction and forcing strokes is provided by some automatic system, the system may also be self-controlled. The output can be increased by connecting any arbitrary number of the equipment units of the invention in series and/or in parallel. The piston-like bodies, blades, membranes, etc. may be manufactured from any arbitrary material (provided that such materials are suitable for the purpose) and in any form. The protected scope of the invention will obviously not be exceeded if a pressure boosting pump is incorporated at any arbitrary point into the primary leg for making up for losses, if necessary, e.g. when delivering slurry.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. A method of delivering a secondary fluid substance from its source by means of the potential energy of a primary liquid column by applying alternative suction and forcing strokes to said secondary fluid substance by means of an exchange of energy between said primary liquid column and said secondary fluid substance, comprising the steps of interposing an axially aligned system of vessels sealed off from the atmosphere between said primary liquid column and said secondary fluid substance;

sucking into said system of vessels a quantum of said secondary fluid substance from its source during each suction stroke by means of the potential energy of said primary liquid column;

ejecting from said system of vessels simultaneously the quantum of primary liquid which had been introduced into said system of vessels during the preceding forcing stroke;

forwarding said ejected quantum of primary liquid to a situs free from the pressure exerted by said primary liquid column;

drawing in a quantum of primary liquid into said system of vessels during each forcing stroke in a direction opposite to the suction stroke;

and ejecting thereby said quantum of secondary fluid substance which had been sucked into said system of vessels during the preceding suction stroke;

a pressure originating from the primary liquid column acting in said system of vessels in the direction of the suction stroke and also during the forcing stroke; and preventing at least in part the mixing of the primary liquid and secondary fluid substance quanta during the alternative forcing and suction strokes.

2. Apparatus for the delivery of a secondary fluid substance by means of the potential energy of a primary liquid column by alternative suction and forcing strokes, comprising in combination, a source of primary liquid having potential energy;

a source of secondary fluid substance;

a downtake conduit leading from the source of primary liquid of conveying the primary liquid;

a conduit for delivery of the second fluid substance from said source of secondary fluid substance operatively communicating therewith;

an axially aligned system of vessles sealed off from the atmosphere;

first shut-off means operatively communicating with said downtake conduit and said system of vessels, and second shut-off means operatively communicating with said source of secondary fluid substance and said systems of vessels;

said system of vessels including a first chamber in communication with said downtake conduit and a second chamber in communication with said secondary fluid substance delivery conduit;

fluid pressure responsive means operatively mounted in said first and second chambers, and adapted to reciprocate between two end positions, and pressure responsive means preventing at least in part the primary liquid and secondary fluid from mixing in said second chamber, said pressure responsive means dividing said second chamber into at least two subchambers the volumes of which vary during the suction and forcing strokes, one of said subchambers being in communication with said downtake conduit via said first shut-off means;

a draining conduit in communication with said one subchamber;

third shut-off means operatively mounted in said draining conduit;

the other of said subchambers being in communication with said conduit for delivery of secondary fluid substance;

an outlet conduit in communication with said delivery conduit;

fourth shut-off means operatively mounted in said outlet conduit;

said fluid pressure responsive means having at least two pressure responsive surfaces which are respectively acted on at least in part by fluid pressure of said primary liquid in opposite direction, one of said pressure responsive surfaces being smaller than the other, said pressure responsive means having a third surface for contacting said secondary fluid substance and sucking it into and expelling it from said system of vessels, said third surface and said pressure responsive surfaces moving in unison.

3. Apparatus for the delivery of a secondary fluid substance by means of the potential energy of a primary liquid column by alternative suction and forcing strokes, comprising in combination, a source of primary liquid having potential energy;

a source of secondary fluid substance;

a downtake conduit leading from the source of primary liquid for conveying the primary liquid;

a conduit for delivery of the secondary fluid substance from said source of secondary fluid substance operatively communicating therewith;

an axially aligned system of vessels sealed off from the atmosphere;

first shut-off means operatively communicating said system of vessels with the downtake conduit, and second shut-off means operatively communicating with said source of secondary fluid substance and said system of vessels;

said systems of vessels including a first chamber in communication with said downtake conduit and a second chamber in communication with said secondary fluid substance delivery conduit;

a mechanism having fluid displacing means reciprocating between two end positions and dividing at least one chamber of the system of vessels into variable-volume spaces during the suction and forcing strokes of such mechanism, the fluid displacing means being fitted with at least two surfaces that can be exposed to actuating pressure of said primary liquid acting from mutually opposite directions, at least one of the said surfaces being located so as to enable direct loading by the head of the primary liquid, the reciprocating mechanism having at least one surface in forced coupling with the aforementioned surfaces so that it is capable of sucking into and forcing out quanta of the secondary fluid substance from the system of vessels, said mechanism being formed by a body comprising a piston and a piston rod, the piston dividing the second chamber into two spaces separated from each other and varying their volumes during operation, the piston rod extending into the first chamber, one space of the second chamber containing the piston being connected via said interposed shut-off means with the downtake conduit and being designed for draining via a draining conduit incorporating a third shut-off means, the other space in the second chamber being connected via the second shut-off means with the source of secondary fluid substance and having an outlet conduit incorporating a fourth shut-off means, the surface of the front face of the piston rod being smaller than the surface of the piston contacting the primary liquid.

4. Apparatus according to claim 3, wherein the areas of the surfaces exposed to the pressure of the primary liquid is equal to those of the surfaces which force out the secondary fluid.

* * * * *